United States Patent [19]

Johnson

[11] 4,416,122

[45] Nov. 22, 1983

[54] UNITARY REMOVABLE REFRIGERATION SYSTEM AND COOLER

[75] Inventor: Robert A. Johnson, Spartanburg, S.C.

[73] Assignee: Tannetics, Inc., Erie, Pa.

[21] Appl. No.: 373,893

[22] Filed: May 3, 1982

[51] Int. Cl.[3] ..... F25D 19/02

[52] U.S. Cl. ..... 62/448

[58] Field of Search ..... 62/448, 449, 450

[56] References Cited

U.S. PATENT DOCUMENTS

| | | | |
|---|---|---|---|
| 2,490,995 | 12/1949 | Chapman | 62/448 |
| 3,206,943 | 9/1965 | Rice et al. | 62/448 X |
| 3,712,078 | 1/1973 | Maynard et al. | 62/448 |

*Primary Examiner*—Lloyd L. King

*Attorney, Agent, or Firm*—Dority & Flint

[57] ABSTRACT

A unitary refrigeration system for a vertical refrigeration cooler which may be installed and removed as a unit from a front of the cooler without a need to unload the articles in the cooler or move the cabinet. Another important feature of the present invention is to provide a unitary refrigeration system for a vertical cooler in which the compressor and evaporator may be removed as a unit without disconnection of the refrigerant tubing in a convenient and expedient manner from a front of the cabinet. Still another important feature of the present invention is to provide a unitary refrigeration system which may be easily removed from a vertical cooler as a unit for servicing and replaced by a like unit so that the cooler is not rendered inoperable during servicing.

7 Claims, 3 Drawing Figures

UNITARY REMOVABLE REFRIGERATION SYSTEM AND COOLER

BACKGROUND OF THE INVENTION

Horizontal and vertical refrigerator cooler cabinets are utilized commercially to merchandise and dispense such items as milk, drinks, and other beverages stacked on shelves in the cabinets in grocery stores and the like establishments. In the vertical refrigeration cabinets the compressor unit is normally at the bottom of the cabinet and the evaporator coil inside an upper portion of the cabinet with the refrigerant tubing connecting the compressor and evaporator coil being arranged in the back of the cabinet. With this general configuration, cabinets are manufactured in either of two methods: (1) the evaporator and condensing unit tubing connections are made within the cabinet such that the assembled refrigeration system cannot be removed from the cabinet for servicing or replacement; or (2) the system is pre-assembled then installed in the cabinet from the rear of the cabinet such that the tubing is in back of the cabinet and the evaporator is inserted into the cabinet interior through a coverable opening in the top or rear of the cabinet.

However, in servicing these prior coolers, there are times when one component or the complete refrigeration system must be removed for repair or replacement. If the system is removable from the rear of the cabinet, the product containers loaded on interior shelves must be removed and the cabinet pulled away from the wall to provide access and space for removal of the system and subsequent replacement. With either method of installation of the refrigeration system, if a part of the refrigeration system needs to be removed and carried to the shop for servicing or replacement, the beverage must be removed from the cabinet for access and the refrigerant tubing must be cut requiring refitting of the tubing to the system and time consuming operations in the establishment. The refrigeration system is rendered inoperative requiring that the beverages be unloaded and moved to another cooler. Servicing at the site of the refrigeration cooler is often time consuming and inconvenient due to operations in the retail establishment. Furthermore, many localities prohibit this type servicing of refrigeration systems within the establishment.

It has been proposed in U.S. Pat. No. 3,712,078 to provide a refrigeration system which may be installed and removed as one piece. However, the unit includes the compressor and the evaporator in the same section of the cabinet requiring additional cabinetry and insulation in the unit. In vertical refrigerated cabinets it is often more desirable for a number of reasons to enclose the compressor in the lower portion the cabinet and to position the evaporator at the upper portion of the cabinet remotely from the compressor.

Accordingly, an important object of the present invention is to provide a unitary refrigeration system for a vertical refrigeration cooler which may be installed and removed as a unit from a front of the cooler without a need to unload the articles in the cooler or move the cabinet.

Another important object of the present invention is to provide a unitary refrigeration system for a vertical cooler in which the compressor and evaporator may be removed as a unit without disconnection of the refrigerant tubing in a convenient and expedient manner from a front of the cabinet.

Still another important object of the present invention is to provide a unitary refrigeration system which may be easily removed from a vertical cooler as a unit for servicing and replaced by a like unit so that the cooler is not rendered inoperable during servicing.

SUMMARY OF THE INVENTION

The above objectives are accomplished according to the present invention by providing a vertical cooler having a lower compressor housing which opens from a front of the cooler cabinet in which a compressor is housed and an upper evaporator compartment in which an evaporator is arranged which may be removed from the front of the cabinet. The refrigerant tubing connecting the compressor and evaporator is routed through a channel member at the front edge of the cooler. The compressor and evaporator may be removed along with the refrigerant tubing as a unit from the front of the cabinet.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
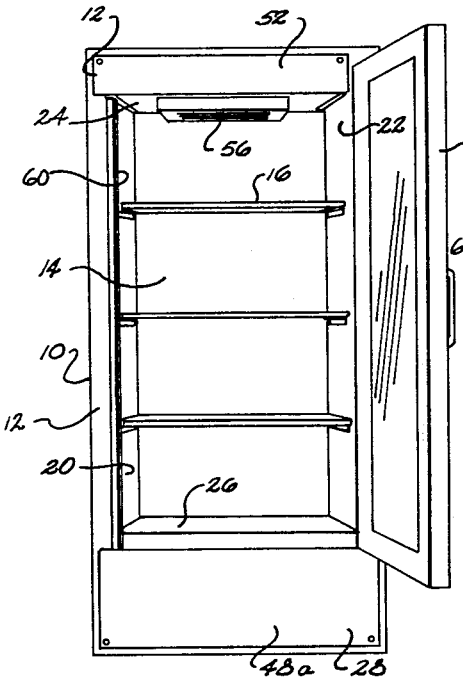
FIG. 1 is a front elevation illustrating a refrigerated cooler and unitary refrigeration system constructed according to the present invention with the compartments of the refrigeration cabinet closed.
Figure 2:
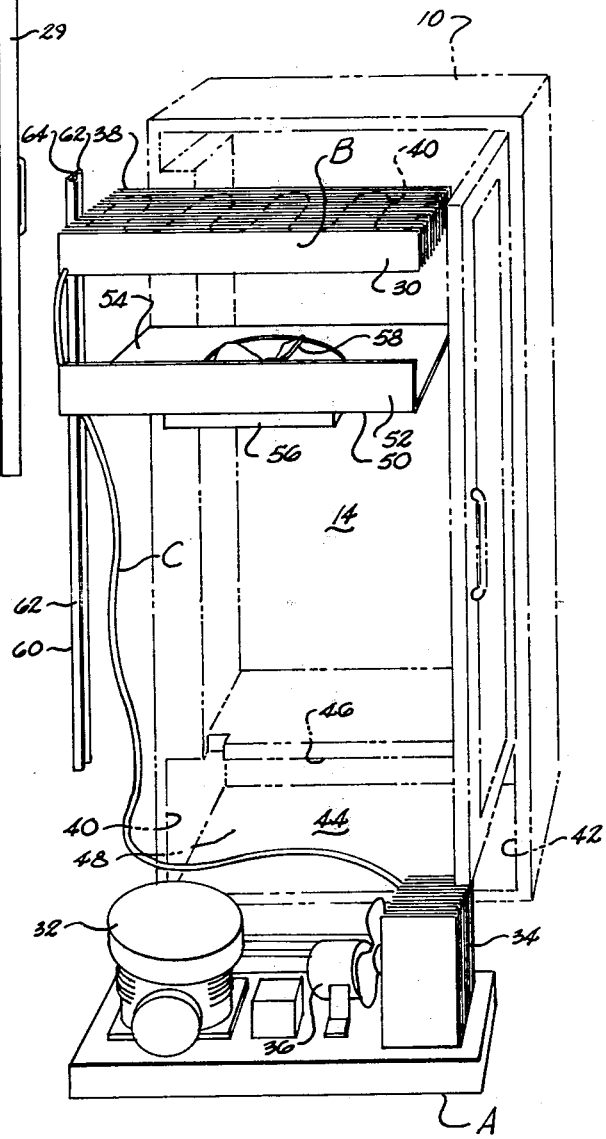
FIG. 2 is a perspective view illustrating a refrigeration system and vertical refrigeration cooler with the refrigeration system removed in a unitary construction according to the invention.
Figure 3:
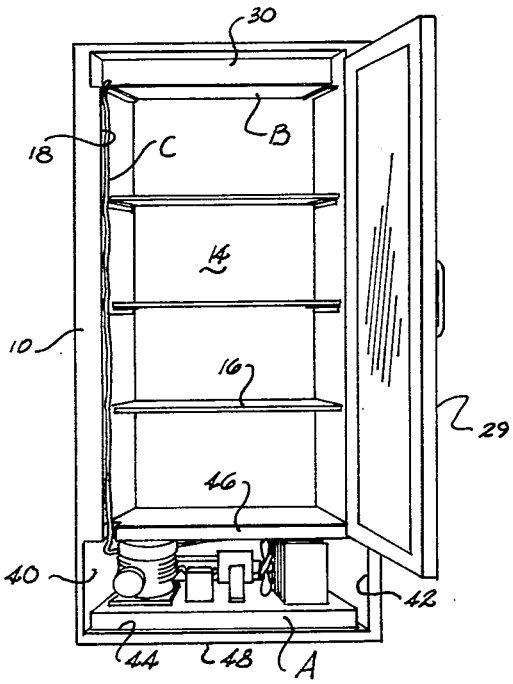
FIG. 3 is an elevation illustrating a vertical refrigeration cooler and refrigeration system with the compressor and evaporator compartments being open for front removal of the system as a unit.

The invention relates to a refrigerated cooler cabinet in which containers of beverages and the like are merchandised and dispensed and particularly to a vertical cooler of the type having a cabinet interior which includes vertically spaced shelves on which the articles are stacked.

Referring now in more detail to the drawing, a vertical refrigerated cabinet 10 is illustrated having a cabinet front 12 which opens into a cabinet interior 14. A plurality of shelves 16 are vertically spaced and retained in the cabinet interior by any suitable means. The cabinet front includes a front opening defined by a rectangular cabinet frame comprising the sides 20 and 22 and top and bottom walls 24 and 26 which define the cabinet interior. A compressor compartment 28 is provided in a lower portion of refrigeration cabinet 10.

The refrigeration unit which is carried in the cabinet includes a compressor A and an evaporator B which may be conventional items and refrigerant tubing C which connects the evaporator and compressor in fluid communication for delivering the refrigerant therebetween. The compressor A typically includes a compressor motor 32 and a condensor coil unit 34 and a cooling fan 36, all of which operate in a conventional manner. The evaporator B normally includes a plurality of fins 38 through which a coil 40 winds back and forth through the fins.

As illustrated, means for compartmentalizing compressor A includes the compressor compartment 28 which is defined by side walls 40 and 42 and a bottom wall 44 and top wall 46 which is arranged between the compressor A and the cabinet interior 14. Top wall 46 serves as the bottom wall 26 of the cabinet interior in the illustrated embodiment. The compartment means is open at the front of the cabinet at 48 and includes a cover plate 48*a* which covers and encloses the compartment with the compressor installed.

Means for compartmentalizing the evaporator is illustrated as including a removable partition housing 50 which includes a vertical plate 52 and horizontal partition wall 54 which serves as the top wall 24 of the cabinet interior in the illustrated embodiment. The partition wall 54 includes means for delivering refrigerated air into the cabinet interior in the form of a grill opening 56 and fan 58 which draws air through the fins and coil of the evaporator B and forces refrigerated air into the cabinet interior for cooling. The air is recirculated through the evaporator B continuously when the fan is on.

Means for channeling the refrigeration tubing C from the compressor A to the evaporator B adjacent the edge 18 of the cabinet interior is provided by a channel member 60 which covers and retains the tubing C in place at the front edge of the cabinet opening. It is to be understood, of course, that other means for channeling and affixing the tubing in place at the front edge may also be utilized so that it may be removed from the front without disturbing the articles on the shelves. The channel member 60 is a generally C-shaped channel member having a pair of spaced legs 62 which straddle the tubing against the side 20 of the cabinet and a web member 64 which bridges the legs 62 and may be secured in place by any suitable means such as machine screws.

Thus, it can be seen that the compartment means 28 and 30 and the channeling means 60 as accessed from the cabinet front, enable the refrigeration unit including compressor A and evaporator B to be removed as a unit with the tubing C for replacement. The need for cutting the refrigerating tubing and the refitting of the tubing in order to service a component of the refrigeration unit is eliminated. The entire unit may be removed from in-shop service and replaced so that the refrigeration cooler is not rendered inoperable during servicing and need not be unloaded.

While a preferred embodiment of the invention has been described using specific terms, such description is for illustrative purposes only, and it is to be understood that changes and variations may be made without departing from the spirit or spirit or scope of the following claims.

What is claimed is:

1. A refrigerated cabinet for merchandising and dispensing beverages and the like containers from vertically spaced shelves in a cabinet interior comprising:

a vertical cabinet having a cabinet front which is open to said cabinet interior;

a refrigeration unit carried in said cabinet including a compressor, an evaporator, and refrigerant tubing connecting said compressor and evaporator in fluid communication;

lower compartment means carried by said cabinet having an open front receiving said compressor for installation and removal from said cabinet front effectively isolating said compressor in said cabinet from said cabinet interior;

upper compartment means housing said evaporator carried in an upper portion of said cabinet, said evaporator being installable and removable from said upper compartment means from said cabinet front;

means channeling said refrigerant tubing from said compressor to said evaporator adjacent a front opening of said cabinet interior; and said compartment means and channeling means facilitating removal and replacement of said refrigeration unit from the front of said cabinet for servicing without need of removing said containers from said shelves or moving said cabinet.

2. The apparatus of claim 1 wherein said means channeling said refrigerant tubing includes means retaining said tubing adjacent said front opening of said cabinet.

3. The apparatus of claim 1 wherein said means channeling said refrigeration tubing includes a generally C-shaped member carried by said cabinet adjacent said front edge covering said tubing generally along said edge.

4. The apparatus of claim 1 wherein said upper compartment means is defined by a housing removable from said cabinet front enclosing said evaporator having a horizontal partition wall defining an upper wall of said cabinet interior.

5. The apparatus of claim 4 including an air flow opening formed in said partition wall and means for delivering refrigerated air through said opening into said cabinet interior.

6. The apparatus of claim 5 wherein said means for delivering refrigerated air includes a blower arranged to draw air through said evaporator and deliver said air into outwardly said cabinet interior.

7. Refrigerated cooler apparatus of the type which includes a vertical cabinet having a cabinet interior in which beverages and the like are stored for display and merchandising on vertically spaced shelves carried within said cabinet, the cabinet interior being open from a cabinet front which may be closed by a cabinet door, said apparatus comprising:

a compressor compartment arranged within a lower portion of said cabinet having an open front defined by integral back and side walls and bottom and top walls, said top wall being disposed between said compressor and said cabinet interior;

a compressor carried in said compressor compartment;

said open front of said compressor compartment facilitating installation and removal of said compressor from the said cabinet front;

an evaporator compartment arranged in an upper portion of said cabinet having a lower partition wall between said evaporator and said cabinet interior defining an upper wall thereof;

an evaporator carried in said evaporator compartment being removable from said upper compartment portion from said cabinet front;

refrigerant tubing connecting said compressor unit and evaporator;

vertical channel means routing said tubing within said cabinet interior adjacent a front edge of said cabinet interior opening adjacent said shelves;

said compressor, evaporator, and refrigerant tubing being installable and removable as a unit from said cabinet front facilitating replacement and servicing without need of moving the position of said cabinet or unloading beverages from within said cabinet interior.

* * * * *